United States Patent [19]

Inaba et al.

[11] Patent Number: 4,616,240

[45] Date of Patent: Oct. 7, 1986

[54] THERMOSENSITIVE RECORDING SHEET

[75] Inventors: Norihiko Inaba; Hiroshi Sakamoto; Takanori Motosugi, all of Numazu, Japan

[73] Assignee: Ricoh Company, Ltd., Tokyo, Japan

[21] Appl. No.: 718,828

[22] Filed: Apr. 2, 1985

Related U.S. Application Data

[63] Continuation of Ser. No. 492,080, May 6, 1983, abandoned.

[30] Foreign Application Priority Data

May 28, 1982 [JP] Japan ..... 57-89878

[51] Int. Cl.[4] ..... B41M 5/18

[52] U.S. Cl. ..... 346/208; 346/200; 346/207; 346/214; 346/226; 427/152

[58] Field of Search ..... 346/200, 207, 214, 226, 346/208, 209; 427/150, 151, 152

[56] References Cited

U.S. PATENT DOCUMENTS 4,388,362 6/1983 Iwata et al. ..... 428/331

4,415,627 11/1983 Miyauchi et al. ..... 346/209

FOREIGN PATENT DOCUMENTS 0027394 3/1981 Japan ..... 346/226

0029491 2/1982 Japan ..... 346/226

*Primary Examiner*—Bruce H. Hess

*Attorney, Agent, or Firm*—Flynn, Thiel, Boutell & Tanis

[57] ABSTRACT

A thermosensitive recording sheet comprises a support material; a thermosensitive coloring layer formed on the support material, comprising a colorless or light-colored leuco dye, and an acidic material which colors the leuco dye upon application of heat thereto; and a protective layer formed on the thermosensitive coloring layer, comprising a water-soluble polymeric binder and silica powder with an oil absorption of 150% or more and with a bulk density of 5 ml/g or more, which are measured in accordance with Japanese Industrial Standard K 5101. This thermosensitive recording sheet has high dynamic thermal coloring sensitivity, is capable of yielding sharp images with high image density at low energy consumption with good thermal head-matching properties, and is resistant to chemicals.

20 Claims, No Drawings

THERMOSENSITIVE RECORDING SHEET

This application is a continuation of U.S. Ser. No. 492,080, filed May 6, 1983, now abandoned.

BACKGROUND OF THE INVENTION

The present invention relates to a thermosensitive recording sheet, and more particularly to a thermosensitive recording sheet comprising a support material; a thermosensitive coloring layer formed on the support material, comprising a colorless or light-colored leuco dye, and an acidic material which colors the leuco dye upon application of heat thereto; and a protective layer formed on the thermosensitive coloring layer, comprising silica powder with an oil absorption of 150% or more and with a bulk density of 5 ml/g or more, which thermosensitive recording sheet is particularly improved with respect to the resistance to chemicals, high speed coloring performance and thermal-head-matching properties.

It is conventionally known that a light-colored leuco dye reacts with an organic acidic material and is colored upon melting of the leuco dye and the acidic material under application of heat hereto.

Examples of thermosensitive recording sheets in which this reaction is applied are disclosed, for instance, in Japanese Patent Publication Nos. 43-4160 and 45-14039.

Recently, those thermosensitive recording sheets have been employed in a variety of fields, for instance, for use with recorders for measurement instruments and terminal printers for computers, facsimile apparatus, automatic ticket vending apparatus, and thermosensitive copying apparatus, and as bar-code labels.

In accordance with recent remarkable improvements in the performance of the above-mentioned apparatus and the application thereof to a variety of new fields, there is a great demand for thermosensitive recording sheets which can complement those improved apparatus. More specifically, there are demanded thermosensitive recording sheets capable of yielding sharp images with high density at low energy consumption, for use with high-speed thermal pens or heads, without generating materials which adhere, for instance, in the form of particles, to the thermal pens or heads during the recording process when heat is applied to the recording sheets through the thermal pens or heads. In the case of conventional thermosensitive sheets, during the application of heat to the thermosensitive sheets by a thermal pen or head during thermal printing, materials contained in the thermosensitive coloring layer are fused and adhere, in the form of particles, to the thermal pen or head.

The particles then stick to the thermosensitive recording sheet itself and hinder the feeding thereof, or they are transferred back to the recording sheet, leaving trailing marks on the recording sheet. When the sticky particles accumulate on the thermal pen or head, image density and image sharpness tend to decrease, and images are deformed.

These conventional thermosensitive recording sheets are also slow in thermal response, not allowing rapid recording with high image density and high image sharpness.

In a thermosensitive recording sheet with a thermosensitive coloring layer comprising a leuco dye and an acidic material which colors the leuco dye upon application of heat thereto, the coloring is caused by either the leuco dye or the acidic material or both of them being fused by the thermal energy supplied by a thermal pen or head, followed by the reaction of the leuco dye and the acidic material to form a certain color.

In order to increase the thermal coloring sensitivity of the thermosensitive recording sheet, there have been proposed methods in which a thermo-fusible material is added to the thermosensitive coloring layer, which thermo-fusible material melts at a temperature lower than the melting points of either the leuco dye or the acidic material, and is capable of melting both the leuco dye and the acidic material when melted.

Examples of such thermo-fusible materials are disclosed, for instance, in the following Japanese laid-open patent applications: nitrogen-containing compounds, such as acetamide, stearamide, m-nitroaniline, and phthalic acid dinitrile in Japanese Laid-Open Patent Application No. 49-34842; acetoacetanilide in Japanese Laid-Open Patent Application No. 52-106746; and alkylated biphenyls and biphenyl alkanes in Japanese Laid-Open Patent Application No. 53-39139.

Even methods of increasing the thermal coloring sensitivities of the thermosensitive recording sheets by use of the above-mentioned compounds, however, are not adequate with recently developed high-speed thermal heads, for instance, for new facsimile apparatus with increased transmission speeds. Furthermore, in the case of high-speed thermal pens and heads, due to quick alternations of their energized and deenergized states, heat tends to accumulate around the thermal pen or head during thermal recording. As a result, the background of the thermosensitive recording sheet is also apt to be colored by the accumulated heat.

In order to prevent the coloring of the background area by the accumulated heat around the thermal pen or head, it is necessary to increase the thermal sensitivity of the thermosensitive recording sheet in such a manner that the recording sheet is colored with high contrast by a small temperature difference and at a high speed. This type of thermal sensitivity is referred to as dynamic thermal coloring sensitivity.

By use of the above-mentioned conventional thermo-fusible materials, the coloring initiation temperature of a leuco dye and an acidic material can be decreased when a heated thermal pen or head is in static contact with the thermosensitive recording sheet employing such thermo-fusible materials, thus increasing the thermal sensitivity of the thermosensitive recording sheet. In contrast to the just mentioned dynamic thermal coloring sensitivity, this type of thermal sensitivity is referred to as static thermal coloring sensitivity.

The above-mentioned conventional thermo-fusible materials can increase the static thermal coloring sensitivity, but cannot always increase the dynamic thermal coloring sensitivity. When increasing the dynamic thermal coloring sensitivity by use of those thermo-fusible materials, it is necessary to add a large amount of the thermo-fusible materials to the thermosensitive coloring layer. However, when a large amount of the thermo-fusible materials is added to the thermosensitive coloring layer, materials contained in the thermosensitive coloring layer are apt to be fused and adhere to the thermal pen or head. Further, when a large amount of the thermo-fusible materials is added to the thermosensitive coloring layer, the coloring initiation temperature of the thermosensitive coloring layer so decreases that its preservability before use becomes poor in practice, with easy occurrence of fogging in the thermosensitive coloring layer.

When increasing the dynamic thermal coloring sensitivity of a thermosensitive recording sheet by other means, it is not always advisable, from the above-mentioned point of view, to decrease the coloring initiation temperature of the thermosensitive coloring layer.

In order, then, to increase the dynamic thermal coloring sensitivity, a method of increasing the smoothness of the surface of the thermosensitive coloring layer, and a method of decreasing the content of components which do not contribute to the thermal coloring reaction, such as fillers and binder agents, in the thermosensitive coloring layer, thereby relatively increasing the contents of the coloring material, have been proposed.

The surface of the thermosensitive coloring layer can easily be made smooth by subjecting the thermosensitive recording sheet to super-calendering. However, by that super-calendering, the surface appearance of the thermosensitive recording sheet is considerably impaired, for instance, with the background of the recording sheet colored or with the surface thereof becoming unpleasantly shiny.

Further, reduction in the amounts of fillers and binders is not always advisable. For example, in order to make the background of the thermosensitive recording sheet look white in color, and to prevent materials which adhere to the thermal pen or head from coming out of the thermosensitive coloring layer during the recording process, fillers, such as calcium carbonate, clay and urea-formaldehyde resin in the form of small particles, and water-soluble binder agents for binding the coloring components and other additives and fixing them to a support material, are added to the thermosensitive coloring layer. When the contents of these fillers and binder agents are reduced, as a matter of course, the above-mentioned objects of the addition of those fillers and binder agents cannot be attained. Consequently, the method of decreasing the content of the fillers and binder agents in the thermosensitive coloring layer is not effective, as a practical matter, for increasing the dynamic thermal coloring sensitivity.

A conventional thermosensitive recording sheet with an unprotected thermosensitive coloring layer has the shortcoming that the image areas and non-image areas formed on the thermosensitive recording sheet lose their color or discolor upon contact with chemicals which are commonly used in homes, schools, offices and other places.

For instance, when the thermosensitive recording sheet is used as labels indicating prices and/or contents which are thermally printed thereon, for instance, for use in supermarkets and other stores, there are many chances of those labels coming into contact with a variety of oils and sources, salt, vinegar and other materials, whereby the printed images on the labels lose their color and become illegible in a certain period of time. Further when the thermosensitive sheets are used in homes, schools or offices, they may also come into contact with organic solvents, plasticizers, and other chemicals, such as acids and alkali materials, contained, for instance, in adhesive agents, plastic wrapping films, erasers, writing instruments, inks and adhesive tapes, and thus the printed images on the thermosensitive recording sheet will lose their color and become illegible.

Therefore, the above-mentioned unprotected thermosensitive recording sheet is not always a secure recording medium for practical use. As a matter of course, under such circumstances, there is a great demand for a thermosensitive recording sheet improved in the above discussed shortcomings of the conventional thermosensitive recording sheets.

SUMMARY OF THE INVENTION

It is therefore an object of the present invention to provide a thermosensitive recording sheet with high dynamic thermal coloring sensitivity, capable of yielding sharp images with high image density at low energy consumption, with high resistance to chemicals and other adverse materials, and with good thermal-head-matching properties such that materials are not generated which come out of the thermosensitive recording layer and adhere to the thermal pen or head during recording process, thereby causing the thermal pen or head to stick to the thermosensitive recording sheet.

The above-described object of the present invention is attained by a thermosensitive recording sheet comprising a support material; a thermosensitive coloring layer formed on the support material, comprising as the main components a colorless or light-colored leuco dye, and an acidic material which colors the leuco dye upon application of heat thereto; and a protective layer formed on the thermosensitive coloring layer, comprising silica powder with an oil absorption of 150% or more and with a bulk density of 5 ml/g or more.

DETAILED DESCRIPTION OF THE PREFERRED EMBODIMENT

A thermosensitive recording sheet according to the present invention comprises a support material; a thermosensitive coloring layer formed on the support material, comprising a colorless or light-colored leuco dye, an acidic material which colors the leuco dye upon application of heat thereto, preferably with addition thereto of a filler and a binder agent; and a protective layer formed on the thermosensitive coloring layer, comprising silica powder with an oil absorption of 150% or more and with a bulk density of 5 ml/g or more. The thermosensitive coloring layer in the present invention further comprises a thermo-fusible material when necessary.

In the present invention, the thermosensitive coloring layer formed on the support material is significantly improved with respect to the dynamic thermal coloring sensitivity, as compared with the thermosensitive coloring layer of a conventional thermosensitive recording sheet.

It is preferable that the amount of the filler be not more than 3 times by weight the amount of the leuco dye, and that the amount of the binder agent be in the range of 3 to 10 wt. % of the total weight of the thermosensitive coloring layer.

The filler is not an indispensable component for the thermosensitive coloring layer. However, when it is added to the thermosensitive coloring layer in an amount not more than 3 times by weight the amount of the leuco dye in the thermosensitive coloring layer, it serves to deepen the color of the developed images without any adverse effects on the coloring thermosensitivity of the thermosensitive coloring layer.

When the amount of the binder agent is less than 3 wt. % of the total weight of the thermosensitive coloring layer, the binding effect of the binder agent is insufficient for this thermosensitive recording layer, while, when the amount of the binder agent is more than 10 wt.

% of the total weight of the thermosensitive coloring layer, the dynamic thermal coloring sensitivity of the thermosensitive coloring layer decreases.

In contrast to this invention, in a conventional thermo-sensitive recording sheet comprising a support material and a thermosensitive coloring layer formed thereon, the amount of a binder agent added to the thermosensitive coloring layer is in the range of as much as 15 wt. % to 30 wt. % of the total weight of the thermosensitive coloring layer.

As for the acidic material which serves to color the leuco dye when heat is applied thereto, it is preferable that the amount of the acidic material be in the range of 2 to 6 times by weight the amount of the leuco dye.

As the colorless or light colored leuco dye in the thermosensitive coloring layer, triphenylmethane-type leuco compounds, fluoran-type leuco compounds, phenothiazine-type leuco compounds, auramine-type leuco compounds and spiropyran-type leuco compounds, are preferably employed. The following are examples of those leuco compounds:

(1) Triphenylmethane-type leuco compounds of the general formula

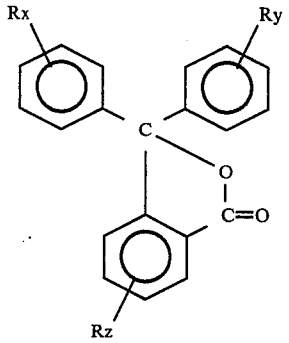

wherein $R_X$, $R_Y$ and $R_Z$ are individually hydrogen, a hydroxyl group, halogen, an alkyl group, a nitro group, an amino group, a dialkylamino group, a monoalkylamino group or an aryl group.

Specific examples of the above compounds are as follows:

3,3-bis(p-diethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide
3,3-bis(p-dimethylaminophenyl)-6-chlorophthalide, and
3,3-bis(p-dibutylaminophenyl)-phthalide.

(2) Fluoran-type leuco compounds of the general formula

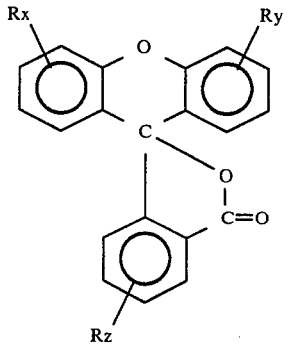

wherein $R_x$, $R_y$ and $R_z$ are individually hydrogen, a hydroxyl group, halogen, an alkyl group, a nitro group, an amino group, a dialkylamino group, a monoalkylamino group or an aryl group.

Specific examples of the above compounds are as follows:

3-cyclohexylamino-6-chlorofluoran,
3-(N,N-diethylamino)-5-methyl-7-(N,N-dibenzylamino) fluoran,
3-dimethylamino-5,7-dimethylfluoran,
3-diethylamino-7-methylfluoran, and
3-diethylamino-7,8-benzfluoran.

(3) Other fluoran-type leuco compounds including 3-diethylamino-6-methyl-7-chlorofluoran,
3-pyrrolidino-6-methyl-7-anilinofluoran,
2-[N-(3-trifluoromethylphenyl)amino-]-6-diethylaminofluoran, and
2-[3,6-bis(diethylamino)-9-(o-chloroanilino) xanthylbenzoic acid lactam].

(4) Lactone compounds of the general formula

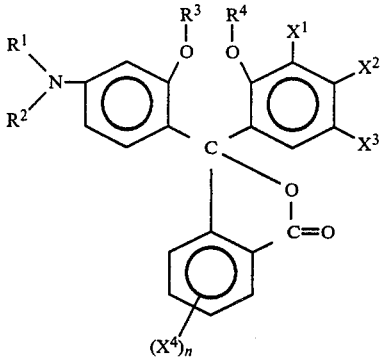

wherein $R^1$ and $R^2$ individually represent hydrogen, a lower alkyl, a substituted or unsubstituted aralkyl group, a substituted or unsubstituted phenyl group, a cyanoethyl group, or a $\beta$-halogenated ethyl group, or $R^1$ and $R^2$ in combination represent $-(CH_2)_4-$, $-(CH_2)_5-$, or $-(CH_2)_2O(CH_2)_2-$; $R^3$ and $R^4$ individually represent hydrogen, a lower alkyl group, an amino group or a phenyl group, and either $R^3$ or $R^4$ is hydrogen; $X^1$, $X^2$ and $X^3$ individually represent hydrogen, a lower alkyl group, a lower alkoxy group, halogen, a halogenated methyl group, a nitro group, or a substituted or unsubstituted amino group; $X^4$ represents hydrogen, halogen or a lower alkyl group or a lower alkoxy group; and n is an integer of 0 through 4.

Specific examples of the above-mentioned compounds are as follows:

3-(2'-hydroxy-4'-dimethylaminophenyl)-3-(2'-methoxy-5'-chlorophenyl) phthalide,
3-(2'-hydroxy-4'-dimethylaminophenyl)-3-(2'-methoxy-5'-nitrophenyl) phthalide,
3-(2'-hydroxy-4'-diethylaminophenyl)-3-(2'-methoxy-5'-methylphenyl) phthalide, and
3-(2'-methoxy-4'-dimethylaminophenyl)-3-(2'-hydroxy-4'-chloro-5'-methylphenyl) phthalide.

As the acidic materials for coloring the leuco dyes when heat is applied thereto, phenolic acidic materials, organic acids, and polyvalent metallic salts of organic carboxylic acids can be employed:

Specific examples of those acidic materials are as follows:

α-naphthol, β-naphthol, 4-t-butylphenol,
4-phenylphenol, 2,2'-bis(p-hydroxyphenyl) propane,
2,2'-bis(p-hydroxyphenyl) butane,
4,4'-cyclohexylidene diphenol,
4,4'-isopropylidene bis(2-t-butylphenol),
benzoic acid,
salicylic acid,
3,5-di-t-butyl zinc salicylate,
3,5-di-t-butyl tin salicylate,
propyl-p-hydroxybenzoate,
benzyl-p-hydroxybenzoate.

As the filler, inorganic fillers and organic fillers, which are conventionally employed for manufacturing paper or for coating paper, for example, calcium carbonate, clay, talc, silica, polystyrene resin, and urea-formaldehyde resin in the form of small particles, can be employed.

As the binder agent, water-soluble polymers such as polyvinyl alcohol, cellulose ether, starch, ammonium polycarboxylates, and alkaline salts of isobutylene-maleic anhydride copolymer; and aqueous emulsions of styrene-butadiene latex, of styrene-acrylic acid ester, and of vinyl acetate, can be employed. Of these binder agents, binder agents which become water-resistant after they are dried, such as ammonium polycarboxylates, and alkaline salts of isobutylene-maleic anhydride copolymer are most preferable for use.

The thermo-fusible material, which is not an indispensable component for the thermosensitive coloring layer, is added to the thermosensitive coloring layer in order to decrease the melting points of the coloring components, that is, the leuco dye and the acidic material, to the range from 70° C. to 120° C.

For example, in the case where 3-diethylamino-o-phloroanilino-fluoran is employed as a leuco dye, and benzyl-p-hydroxybenzoate (m.p. 109° C.) is employed as an acidic material, a melting point measurement by use of a Differential Scanning Calorimeter (hereafter referred to as the DSC) indicated that the mixture of the two melted at 84° C. to 95° C. For this thermosensitive coloring system, thermo-fusible materials are unnecessary. In contrast to this, when the benzyl-p-hydroxybenzoate was replaced by Bisphenol A in the above thermosensitive coloring system, the melting point of the mixture of the coloring components was measured to be in the range of 130° C. to 155° C. by use of the DSC. In this case, it is necessary to decrease the melting point of the coloring components, to about 70° C. to 80° C., for instance, by addition of stearamide thereto. Otherwise, the dynamic thermal coloring sensitivity of the thermosensitive coloring layer cannot be increased sufficiently for this invention.

As such thermo-fusible materials, higher fatty acid amides and derivatives thereof; higher fatty acid metallic salts; animal waxes and vegetable waxes; and petroleum waxes such as polyethylene, paraffin and microcrystalline, can be employed in the present invention. As described above, the thermosensitive coloring layer is formulated so as to increase the dynamic thermal coloring sensitivity thereof. However, this alone does not improve the head-matching properties of the thermo-sensitive coloring layer. In order to improve the head-matching properties and resistance to chemicals, a protective layer comprising as the main components a water-soluble polymeric binder agent and particular silica powder is formed on the thermosensitive coloring layer in the present invention.

As the water-soluble polymeric binder agent, for example, polyvinyl alcohol, cellulose ether, starch, ammonium polycarboxylates, and alkaline salts of isobutylene-maleic anhydride copolymer can be employed.

It is preferable that the amount of the water-soluble polymeric binder agent be in the range of 30 wt. % to 90 wt. % of the total weight of the protective layer, the amount of the silica powder be in the range of 70 wt. % to 10 wt. % of the total weight of the protective layer, and the coating amount of the protective layer be in the range of 1 g/m$^2$ to 6 g/m$^2$. When the water-soluble polymeric binder agent is less than 30 wt. %, the binding force of the binder agent between the thermosensitive coloring layer and the protective layer becomes weak and the dynamic thermal coloring sensitivity of the thermosensitive coloring layer somehow decreases. On the other hand, when the amount of the water-soluble polymeric binder agent is more than 90 wt. %, sticking of the thermal pen or head to the thermosensitive recording sheet is apt to occur. When the amount of the silica powder is more than 70 wt. %, the film formation properties of the protective layer deteriorate, and the protective layer does not work as desired. When the amount of the silica is less 10 wt. %, sticking of the thermal pen or head to the thermosensitive coloring layer is apt to occur and the thermal pen or head makes much sticking noise.

For further increase of the dynamic thermal coloring sensitivity of the thermosensitive coloring layer, and for further improvement of the thermal-head-matching properties, thermo-fusible materials such as higher fatty acid amides and derivatives thereof; higher fatty acid metallic salts; animal waxes and vegetable waxes; and petroleum waxes such as polyethylene, paraffin and microcrystalline, can be added to the protective layer, in an amount of not more than 20 wt. % of the total weight of the protective layer. Further, when necessary, aqueous emulsions of styrene-butadiene latex, of styrene-acrylic acid ester and of vinyl acetate can be employed together with the water-soluble polymeric binder agents.

By the above-described combination of the the thermosensitive coloring layer and the protective layer, the dynamic thermal coloring sensitivity and thermal-head-matching properties and the thermal printing properties of the thermosensitive recording sheet according to the present invention are significantly improved as compared with those of the conventional thermosensitive recording sheets.

It is preferable that the oil absorption and the bulk density of the silica powder for use in the present invention be respectively 150% or more, and 5 ml/g or more, which are measured in accordance with Japanese Industrial Standard (JIS) K 5101 (Testing Methods for Pigments).

More specifically, the oil absorption was measured as follows:

5 g of a sample silica powder was placed on a glass plate (about 250 mm×250 mm×5 mm). Boiled linseed oil was dropped from a burette on the center of the sample placed on the glass plate. The mixture was kneaded throughly with a steel spatula. The dropwise addition of the linseed oil and kneading of the sample were continued until the oil-absorbed mixture became putty-like and could be rolled up in a spiral shape with the steel spatula. At this state, addition of the oil was stopped and the total amount of the added oil was measured and the oil absorption (%) G was calculated in accordance with the following formula:

$$G=(H/S)\times 100$$

where

G: oil absorption (%)

H: amount of linseed oil required (ml)

S: Weight of the sample (g)

The bulk density of the silica powder was measured as follows:

A thermosensitive recording sheet according to the present invention can be prepared as follows:

A bulk measuring apparatus (not shown) comprising a funnel supporter and a receiver supporter disposed under the funnel supporter was horizontally held. A funnel was fixed to the funnel supporter and a sieve was mounted on the funnel. A sample receiver (30 ml) was placed on the receiver supporter so as to be positioned right under the funnel.

A spoonful of a silica powder sample was spread uniformly over the sieve with a relatively stiff brush (about 15 mm wide and 20 mm long) so as to cause the sample to pass through the sieve and to be placed in the sample receiver through the funnel. This procedure was continued until the sample poured into the sample receiver slightly flowed over the brim. The excess portion of the sample above the brim was scraped off with a spatula with a straight edge. The silica sample in the sample receiver was weighed and the bulk density of the sample was calculated in accordance with the following formula:

$$E=30/F$$

where

E: Bulk density (ml/g)

F: Weight (g) of the sample filled in the sample receiver

When the oil absorption of the silica powder is less than 150%, the head-matching properties of the thermosensitive recording sheet deteriorate and sticking of the thermal head or pen to the thermosensitive recording sheet is apt to occur. When the bulk density of the silica powder is less than 5 ml/g, the thermal pen or head is considerably abraded while in use.

A thermosensitive recording sheet according to the present invention can be prepared as follows:

Two thermosensitive coloring liquids are prepared separately, one for a leuco dye liquid and the other for an acidic material liquid. To each of the thermosensitive coloring liquids, an aqueous solution of a water-soluble polymer, such as polyvinyl alcohol, hydroxyethyl cellulose, alkali salts of styrene-maleic anhydride copolymers, or starch, is added. Each mixture is subjected to grinding in a grinding apparatus, for instance, in a ball mill, an attritor or a sand mill, until the particles dispersed in the mixture are ground to particles with a size ranging from 1 μm to 3 μm. When necessary, a filler, a dispersion of a thermo-fusible material, or a defoaming agent, is added to each thermosensitive coloring liquid.

These thermosensitive coloring liquids are mixed to form a thermosensitive coloring layer liquid for forming a thermosensitive coloring layer.

A protective layer coating liquid is prepared by mixing or dispersing silica powder, a thermo-fusible material and a water-soluble polymeric binder agent.

These coating liquids are successively coated on a support material, such as a sheet of conventional high quality paper or synthetic paper to prepare a thermosensitive recording sheet according to the present invention.

The specific dynamic thermal coloring sensitivity of a thermosensitive recording sheet according to the present invention may be assessed as follows, as compared with the dynamic thermal coloring sensitivity of a conventional thermosensitive recording sheet consisting of a support material and a thermosensitive coloring layer.

Thermal printing was performed on the thermosensitive recording sheet according to the present invention by use of a thermal head for a facsimile apparatus, including a heat-emitting resistor with a resistance of about 300 ohms under the conditions that the main scanning recording speed was 20 ms/line, the scanning line density was 8 dots×3.85 dots/mm, the platen pressure was 1.4 kg and the head voltage was 13 volts with a voltage application time of 1.88 msec.

The thus obtained image density measured more than 1.20 by a Macbeth densitometer RD-514 with a Wratten-106 filter. In contrast to this, the conventional thermosensitive recording sheet yielded an image density of 1.1 or less under the same thermal printing conditions as mentioned above. In the case of the conventional thermosensitive recording sheet, the thermosensitive recording sheet stuck to the thermal head during thermal recording.

In the case of the thermosensitive recording sheet according to the present invention, however, no materials which could adhere to the thermal head were produced during the printing process and therefore the thermosensitive recording sheet did not stick to the thermal head at all, unlike in the case of the conventional thermosensitive recording sheet.

In order to investigate the resistance to chemicals and oils of the thermosensitive recording sheet according to the present invention, images were formed on the thermosensitive recording sheet in the above described procedure and ethanol, a commercially available hair oil or salad oil was applied to the surface of the image-bearing thermosensitive recording sheet. The result was that the image areas and the non-image areas were not substantially discolored.

In the present invention, a back-coat layer comprising as the main component a water-soluble polymeric binder agent or an aqueous emulsion binder agent can be formed on the back side of the support material, opposite to the protective layer, in order to prevent the thermosensitive recording sheet from curling and to increase the solvent resisting properties of the thermosensitive recording sheet. Further, an under-coat layer comprising substantially the same components as those in the back-coat layer can be formed between the thermosensitive coloring layer and the support material for the same purposes as in the back-coat layer.

By referring to the following examples and comparative examples, specific embodiments of a thermosensitive recording sheet according to the present invention will now be explained.

EXAMPLE 1

For preparation of a thermosensitive coloring liquid, Liquid A and Liquid B were prepared by grinding the following respective components in a ball mill until the particles in each liquid were about 1.5 μm in particle size:

| | Parts by Weight |
|---|---|
| Liquid A | |
| 3-(N—cyclohexyl-N—methyl) amino-6-methyl-7-anilinofluoran | 20.0 |
| 10% aqueous solution of polyvinyl alcohol | 16.0 |
| Water | 64.0 |
| Liquid B | |
| Benzyl p-hydroxybenzoate | 10.0 |
| Calcium carbonate | 10.0 |
| 10% aqueous solution of polyvinyl alcohol | 16.0 |
| Water | 54.0 |

One part by weight of the Liquid A and 4 parts by weight of the Liquid B were mixed, so that a thermosensitive coloring liquid was prepared.

A protective layer liquid was prepared by dispersing the following components in a sand mill:

| | Parts by Weight |
|---|---|
| Silica power (with an oil absorption of 300% and a bulk density 10 ml/g) | 2.5 |
| 10% aqueous solution of polyvinyl alcohol | 65.0 |
| Zinc stearate | 1.0 |
| Water | 31.5 |

The thermosensitive coloring liquid was applied to a sheet of high quality paper (50 g/m$^2$) by an air knife to form a thermosensitive coloring layer thereon, and the protective layer liquid was applied to the thermosensitive coloring layer by a four-roller reverse coater to form a protective layer in such a manner that the amount of the thermosensitive coloring layer was 12.7 g/m$^2$, and the amount of the protective layer was 2.0 g/m$^2$, when dried.

The thus prepared thermosensitive recording sheet was subjected to super-calendering in such a manner that its luster was in the range of 10% to 13% as measured in accordance with Japanese Industry Standard (JIS) P8142.

Thereafter, the dynamic coloring sensitivity and the thermal-head-matching properties of the thermosensitive recording sheet were determined by use of a thermal head capable of forming 8 dots/mm and with a heat-emitting resistor of about 300 ohm/dot, in a G-III facsimile apparatus, under the following two test conditions:

(1)

Main scanning recording speed: 20 ms/line
Subscanning: 3.85 l/mm
Platen pressure: 1.4 kg
Thermal head voltage: 13 V
Thermal head energized time: 1.88 msec (2)

Main scanning recording speed: 20 ms/line
Subscanning: 3.85 l/mm
Platen pressure: 1.4 kg
Thermal head voltage: 13 V
Thermal head energized time: 2.19 msec The extent of sticking of the thermosensitive recording sheet to the thermal head was assessed during thermal printing by use of an all-solid original under the above-mentioned second condition with a thermal head energizing time of 2.19 msec, and the generation of materials adhering to the thermal head during thermal printing was assessed by use of a checkered original (the white-to-black-area ratio was 50:50) also under the second condition.

To a sample of the thermosensitive recording sheet with images formed by the G-III facsimile apparatus, under the second condition (with the thermal head energized time being 2.19 msec) ethanol was applied to the entire image-bearing surface of the thermosensitive recording sheet by absorbent cotton soaked with the ethanol, and the image areas and the non-image areas were then visually inspected.

A wrapping film (trade name: Polyma-wrap made by Shin-Etsu Polymer Co., Ltd.) containing DOA (dioctyl adipate) and DOP (dioctyl phthalate) as the main plasticizers was superimposed on another sample of the thermosensitive recording sheet with images formed thereon by the G-III facsimile apparatus under the same conditions as just mentioned above, under application of pressure of 10 kg/cm$^2$ at 40° C. for 1 hour in order to investigate changes in the image areas, if any.

The results of the above-described tests are summarized in Table 1.

EXAMPLE 2

Example 1 was repeated except that the amount of the thermosensitive coloring layer coated on the support material was 3.7 g/m$^2$ and the amount of the protective layer coated on the thermosensitive coloring layer was 4.0 g, when dried.

The thus prepared thermosensitive recording sheet was subjected to the super-calendering in the same manner as in Example 1, and, thereafter, the recording sheet was subjected to the same tests as in Example 1 in order to determine its dynamic coloring sensitivity and thermal-head-matching properties, the extent of the sticking thereof to the thermal head, and to the resistance to ethanol and the same wrapping film as that employed in Example 1.

The results of those tests are summarized in Table 1.

COMPARATIVE EXAMPLE 1

For preparation of a thermosensitive coloring liquid, Liquid A, which was the same as that employed in Example 1 and Example 2, and Liquid C were prepared by grinding the following respective components in an attritor until the particles in each liquid were about 1.5 μm in particle size:

| | Parts by Weight |
|---|---|
| Liquid A | |
| 3-(N—cyclohexyl-N—methyl) amino-6-methyl-7-anilinofluoran | 20.0 |
| 10% aqueous solution of polyvinyl alcohol | 16.0 |

-continued

| | Parts by Weight |
|---|---|
| Water | 64.0 |
| Liquid C | |
| Benzyl p-hydroxybenzoate | 10.0 |
| Calcium carbonate | 12.5 |
| Zinc stearate | 2.5 |
| 10% aqueous solution of polyvinyl alcohol | 12.5 |
| Water | 62.5 |

One part by weight of Liquid A, 8 parts by weight of Liquid C and 1.5 parts by weight of a 20% aqueous solution of starch were mixed, so that a thermosensitive coloring liquid was prepared.

This thermosensitive coloring liquid was directly coated on a sheet of high quality paper (50 g/m$^2$) by a coater in such a manner that the amount of the thermosensitive coloring layer, when dried, was 6.49 g/m$^2$.

In this comparative example, a protective layer was not formed.

The thus prepared comparative thermosensitive recording sheet was subjected to super-calendering in the same manner as in Example 1, and, thereafter, the recording sheet was subjected to the same tests as in Example 1 in order to determine its dynamic coloring sensitivity and thermal-head-matching properties, the sticking thereof to the thermal head, and the resistance to ethanol and to the same wrapping film employed in Example 1.

The results are summarized in Table 1.

COMPARATIVE EXAMPLE 2

A thermosensitive coloring liquid was prepared exactly in the same manner as in Example 1 by mixing one part by weight of the Liquid A and 4 parts by weight of the Liquid B.

A protective layer liquid was prepared by dispersing the following components in a sand mill:

| | Parts by Weight |
|---|---|
| Silica power (with an oil absorption of 90% and a bulk density 2.5 ml/g) | 2.5 |
| 10% aqueous solution of polyvinyl alcohol | 65.0 |
| Zinc stearate | 1.0 |
| Water | 31.5 |

The thermosensitive coloring liquid was applied to a sheet of high quality paper (50 g/m$^2$) by an air knife to form a thermosensitive coloring layer thereon, and the protective layer liquid was applied to the thermosensitive coloring layer by a four-roller reverse coater to form a protective layer in such a manner that the amount of the thermosensitive coloring layer was 12.7 g/m$^2$, and the amount of the protective layer was 2.0 g/m$^2$, when dried.

The thus prepared comparative thermosensitive recording sheet was subjected to the super-calendering in the same manner as in Example 1, and, thereafter, the recording sheet was subjected to the same tests as in Example 1 in order to determine its dynamic coloring sensitivity and thermal-head-matching properties, the extent of the sticking thereof to the thermal head, and to the resistance to ethanol and the same wrapping film as that employed in Example 1.

The results of those tests are summarized in Table 1.

COMPARATIVE EXAMPLE 3

Comparative Example 2 was repeated except that the protective layer formed in Comparative Example 2 was replaced by a protective layer which was prepared by dispersing the following components in a sand mill, so that a comparative thermosensitive recording sheet was prepared with the same coating amount of the thermosensitive coloring layer and with the same coating amount of the protective layer as those in Comparative Example 2.

| | Parts by Weight |
|---|---|
| Calcium carbonate | 2.5 |
| 10% aqueous solution of polyvinyl alcohol | 65.0 |
| Zinc stearate | 1.0 |
| Water | 31.5 |

The thus prepared comparative thermosensitive recording sheet was subjected to the super-calendering in the same manner as in Example 1, and, thereafter, the recording sheet was subjected to the same tests as in Example 1 in order to determine its dynamic coloring sensitivity and thermal-head-matching properties, the extent of the sticking thereof to the thermal head, and to the resistance to ethanol and the same wrapping film as that employed in Example 1.

The results of those tests are summarized in Table 1.

TABLE 1

| | Dynamic Thermal Coloring Sensitivity | | Thermal-Head-Matching Properties | | Adverse Effects of Ethanol on Images | Adverse Effects of Wrapping Film on Images |
|---|---|---|---|---|---|---|
| | 1.88 ms | 2.19 ms | Sticking | Production of Sticky Materials | | |
| Example 1 | 1.30 | 1.34 | Almost none | Almost none | Almost none | Almost none |
| Example 2 | 1.22 | 1.30 | Almost none | None | None | None |
| Comparative Example 1 | 1.00 | 1.25 | Very much | Much | Non-image areas colored | Image areas completely lost their color |
| Comparative Example 2 | 1.29 | 1.34 | Much | Almost none | Almost none | Almost none |
| Comparative Example 3 | 1.27 | 1.32 | Much | Much | Almost none | Almost none |

As can be seen from the above, the embodiments of a thermosensitive recording sheet according to the present invention are excellent in dynamic thermal coloring sensitivity and thermal-head-matching properties and the resistance to ethanol and to the wrapping film, as compared with the comparative examples.

What is claimed is:

1. A thermosensitive recording sheet, comprising:
a support material;
a thermosensitive coloring layer formed on said support material, said thermosensitive coloring layer comprising a colorless or light-colored leuco dye, and an acidic material which develops color in said leuco dye upon application of heat to said thermosensitive coloring layer; and
a protective layer formed on said thermosensitive coloring layer, said protective layer comprising a water-soluble polymeric binder and silica powder having an oil absorption of 150% or higher and a bulk density of 5 ml/g or higher, as measured in accordance with Japanese Industrial Standard K 5101.

2. A thermosensitive recording sheet as claimed in claim 1, wherein the amount of said water-soluble binder agent in said protective layer is in the range of 30 wt. % to 90 wt. % of the total weight of said protective layer, the amount of said silica powder is in the range of 70 wt. % to 10 wt. % of the total weight of said protective layer, and the coating amount of said protective layer is in the range of 1 $g/m^2$ to 6 $g/m^2$.

3. A thermosensitive recording sheet as claimed in claim 1, wherein said protective layer further comprises a thermo-fusible material in an amount of not more than 20 wt. % of the total weight of said protective layer.

4. A thermosensitive recording sheet as claimed in claim 3, wherein said thermo-fusible material is selected from the group consisting of higher fatty acid amides; higher fatty acid metallic salts; animal waxes and vegetable waxes; and petroleum waxes.

5. A thermosensitive recording sheet as claimed in claim 1, wherein said protective layer further comprises an aqueous emulsion of a member selected from the group consisting of styrene-butadiene latex, styrene-acrylic acid ester and vinyl acetate, in an amount of not more than 20 wt. % of the total weight of said protective layer.

6. A thermosensitive recording sheet as claimed in claim 1, wherein said thermosensitive coloring layer further comprises a filler and a binder agent, the amount of said filler is not more than 3 times by weight the amount of said leuco dye, and the amount of said binder agent is in the range of 3 wt. % to 10 wt. % of the total weight of said thermosensitive coloring layer.

7. A thermonsensitive recording sheet as claimed in claim 6, wherein said filler in said thermosensitive coloring layer is selected from the group consisting of calcium carbonate, clay, talc, silica, polystyrene and urea-formaldehyde resin.

8. A thermonsensitive recording sheet as claimed in claim 6, wherein said binder agent in said thermosensitive coloring layer is selected from the group consisting of polyvinyl alcohol, cellulose ether, starch, ammonium polycarboxylates, and alkaline salts of isobutylene-maleic anhydride copolymer; and aqueous emulsions of styrene-butadiene latex, styrene-acrylic acid ester, and vinyl acetate.

9. A thermosensitive recording sheet as claimed in claim 1, wherein the amount of said acidic material is in the range of 2 to 6 times by weight the amount of said leuco dye in said thermosensitive coloring layer.

10. A thermosensitive recording sheet as claimed in claim 1, wherein said colorless or light-colored leuco dye is selected from the group consisting of triphenylmethane-type leuco compounds, fluoran-type leuco compounds, phenolthiazine-type leuco compounds, auramine-type leuco compounds and spiropyran-type leuco compounds.

11. A thermosensitive recording sheet as claimed in claim 1, wherein said acidic material is selected from the group consisting of organic acids and polyvalent metallic salts of organic carboxylic acids.

12. A thermosensitive recording sheet as claimed in claim 1, wherein said thermosensitive coloring layer further comprises a thermo-fusible material for decreasing the melting point of said leuco dye, said acidic material, or both.

13. A thermosensitive recording sheet as claimed in claim 12, wherein said thermo-fusible material is selected from the group consisting of higher fatty acid amides, higher fatty acid metallic salts; animal waxes and vegetable waxes; and petroleum waxes.

14. A thermosensitive recording sheet as claimed in claim 2, wherein said water-soluble binder is selected from the group consisting of polyvinyl alcohol, cellulose ethers, starch, ammonium carboxylates and alkali salts of isobutylene-maleic anhydride.

15. A thermosensitive recording sheet, comprising:
a support material;
a thermosensitive coloring layer formed on said support material, said thermosensitive coloring layer consisting essentially of an amount of a colorless or light-colored leuco dye effective to form a colored image on said coloring layer, said leuco dye being selected from the group consisting of triphenylmethane, fluoran, phenothiazine, auramine and spiropyran-type leuco compounds, and an amount by weight of an acidic material in the range of from 2 to 6 times the amount of weight of said leuco dye, said acidic material being effective to develop color in said leuco dye upon application of heat to said thermosensitive coloring layer, said acidic material being an organic acid or polyvalent metallic salt of an organic carboxylic acid; and
a protective layer formed on said thermosensitve coloring layer, said protective layer consisting essentially of 30 to 90 wt. % of a water-soluble polymeric binder, and 70 to 10 wt. % of silica powder having (1) a bulk density of 5 ml/g or higher as measured by filling a 30 ml sample receiver with said silica powder, measuring the weight F in grams of silica powder contained in said sample receiver, and then determining the bulk density E according to the formula $E=30/F$, said silica powder also having (2) an oil absorption percent amount G of 150% or higher as measured by adding boiled linseed oil dropwise to a sample of said silica powder on a glass plate while kneading the resulting mixture until the sample becomes putty-like and can be rolled up in a spiral shape, then measuring the amount H of oil added, in ml, and determining the oil absorption G according to the formula $G=(H/S)\times 100$, wherein S is the weight of said sample, said protective layer having an amount of coated solids in the range of 1 to 6 $g/m^2$.

16. A thermosensitive recording sheet as claimed in claim 15, wherein said water-soluble binder is selected from the group consisting of polyvinyl alcohol, cellulose ethers, starch, ammonium carboxylates and alkali salts of isobutylene-maleic anhydride.

17. A thermosensitive recording sheet as claimed in claim 15, wherein said protective layer further contains a thermo-fusible material in an amount of not more than 20 wt. %, said thermo-fusible material being selected from the group consisting of higher fatty acid amides and derivatives thereof, higher fatty acid metallic salts, animal waxes, vegetable waxes and petroleum waxes.

18. A thermosensitive recording sheet as claimed in claim 17, wherein said theromsensitive coloring layer further contains a filler in an amount of not more than 3 times the amount by weight of said leuco dye, said filler being selected from the group consisting of calcium carbonate, caly, talc, silica, polystyrene and urea-formaldehyde resin, and said thermosensitve coloring layer also further comprises a binder in an amount in the range of 3 to 10 wt. %, said binder being selected from the group consisting of polyvinyl alcohol, cellulose ether, starch, ammonium polycarboxylates, alkali salts of isobutylene-maleic anhydride copolymers, and aqueous emulsions of styrene-butadiene latex, styrene-acrylic acid ester and vinyl acetate.

19. A thermosensitive recording sheet as claimed in claim 18, wherein said thermosensitive coloring layer further comprises an amount of a thermo-fusible material effective to decrease the melting point of at least one of said leuco dye and said acidic material, said thermo-fusible material being selected from the group consisting of higher fatty acid amides, higher fatty acid metallic salts, animal waxes, vegetable waxes and petroleum waxes.

20. A thermosensitive recording sheet as claimed in claim 15, wherein said protective layer further contains an aqueous emulsion of a member selected from the group consisting of styrene-butadiene latex, styrene-acrylic acid ester and vinyl acetate in an amount of not more than 20 wt. %.

* * * * *